US005943798A

United States Patent [19]

McGuire et al.

[11] Patent Number: 5,943,798

[45] Date of Patent: *Aug. 31, 1999

[54] METHOD OF AND APPARATUS FOR TRENCHING

[76] Inventors: Christopher J. McGuire, 4678 Chimney Rock Rd., Dodgeville, Wis. 53533; Matthew P. McGuire, 1059 Circle Dr., Highland, Wis. 53543; Thomas W. Scholl, 2007 East Windsor Pl., Milwaukee, Wis. 53202

[ * ] Notice: This patent is subject to a terminal disclaimer.

[21] Appl. No.: 08/745,032

[22] Filed: Nov. 7, 1996

Related U.S. Application Data

[63] Continuation-in-part of application No. 08/423,224, Apr. 17, 1995, Pat. No. 5,615,499.

[51] Int. Cl.[6] ..... E02D 17/06

[52] U.S. Cl. ..... 37/367; 37/370; 37/380; 37/404; 37/468

[58] Field of Search ..... 37/367, 370, 366, 37/372, 330, 404, 405, 406, 407, 408, 409, 410, 468, 380; 405/15

[56] References Cited

U.S. PATENT DOCUMENTS

| | | | |
|---|---|---|---|
| 51,067 | 11/1865 | Lugenbell et al. | 37/370 |
| 187,466 | 2/1877 | Humphreys | 37/366 |
| 208,682 | 10/1878 | Humphreys | 37/367 |
| 304,295 | 9/1884 | Colvin | 37/367 |
| 483,476 | 9/1892 | Rinehart | 37/366 |
| 616,300 | 12/1898 | Esty | 37/367 |
| 1,848,635 | 3/1932 | Leriche et al. | 37/366 |
| 2,645,043 | 7/1953 | Booten et al. | 37/98 |
| 2,660,815 | 12/1953 | Lippis | 37/367 |
| 2,670,550 | 3/1954 | Bowen | 37/98 |
| 2,748,506 | 6/1956 | Stpsberg, Jr. | 37/367 |
| 2,865,184 | 12/1958 | Fohr | 37/142 |
| 2,916,835 | 12/1959 | Boyce | 37/98 |
| 3,999,315 | 12/1976 | Nye | 37/141 T |
| 4,704,811 | 11/1987 | Jefferson | 37/80 A |
| 4,892,155 | 1/1990 | Wanamaker | 172/199 |
| 5,273,375 | 12/1993 | Plourde | 404/118 |
| 5,377,766 | 1/1995 | Klinger | 172/782 |
| 5,615,499 | 4/1997 | McGuire et al. | 37/367 |

*Primary Examiner*—Thomas B. Will
*Assistant Examiner*—Victor Batson
*Attorney, Agent, or Firm*—Andrus, Sceales, Starke & Sawall

[57] ABSTRACT

An excavation apparatus adapted for connection to a tool of a construction vehicle comprises a framework having a proximal end and a distal end, the framework including a trenching device positioned intermediate the proximal end and the distal end for digging a furrow in which a silt fence is positioned. The proximal end has a mounting arrangement for clamping the framework to the tool of the construction vehicle and the distal end has a depth limiting arrangement for limiting the digging depth of the trenching device.

14 Claims, 4 Drawing Sheets

FIG. 9
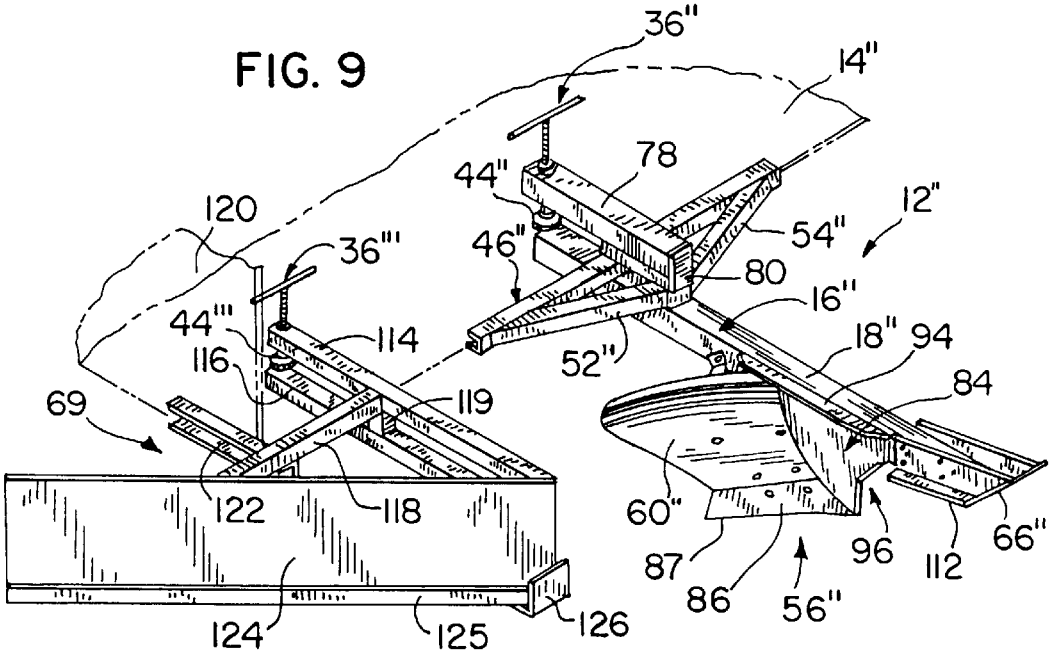
FIG. 10
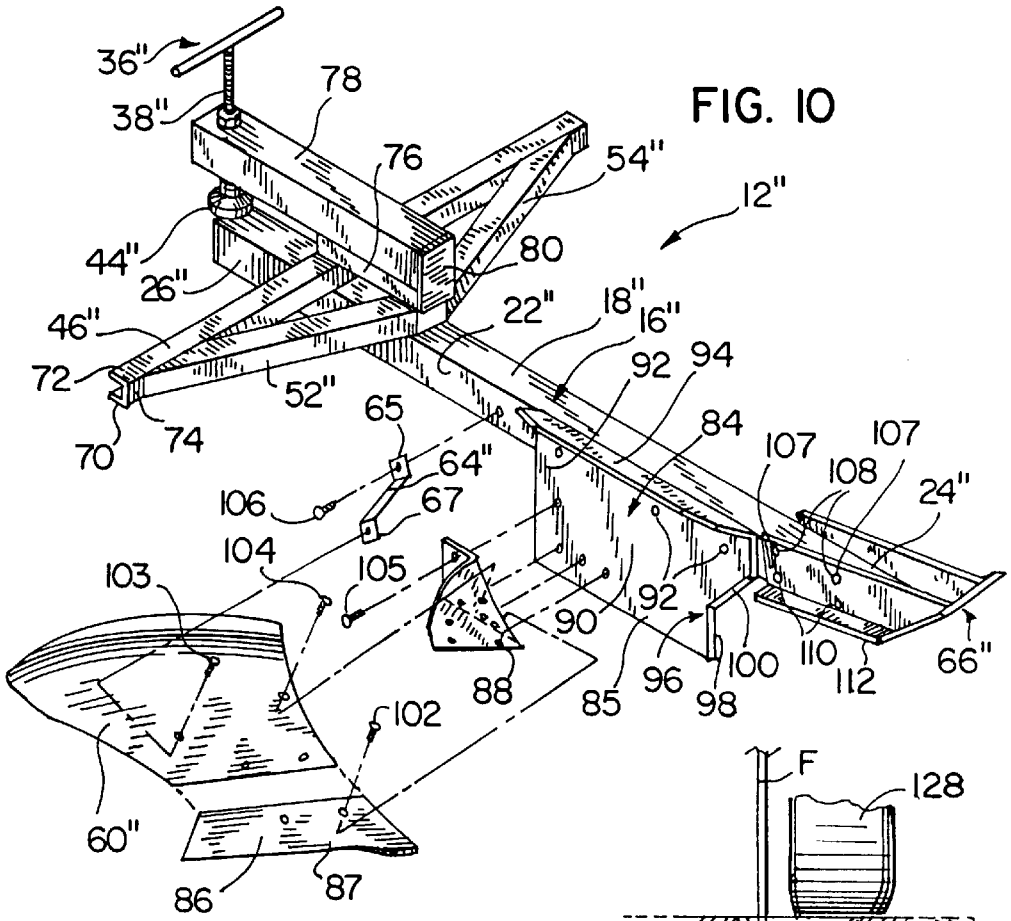
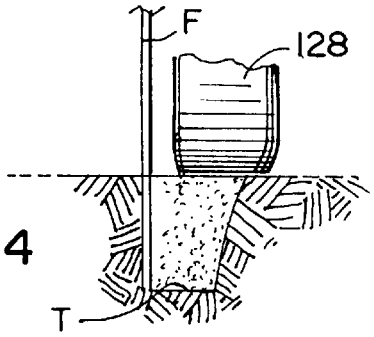
FIG. 14

FIG. 11
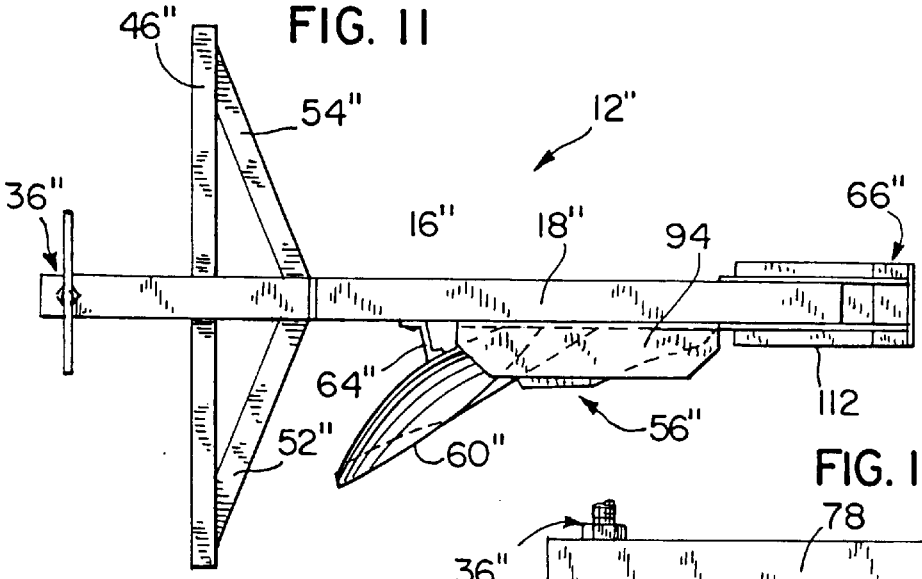
FIG. 12A
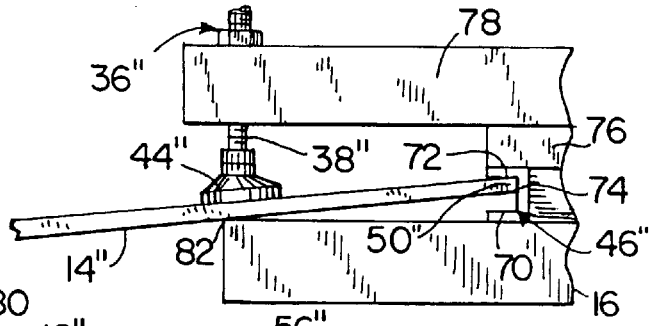
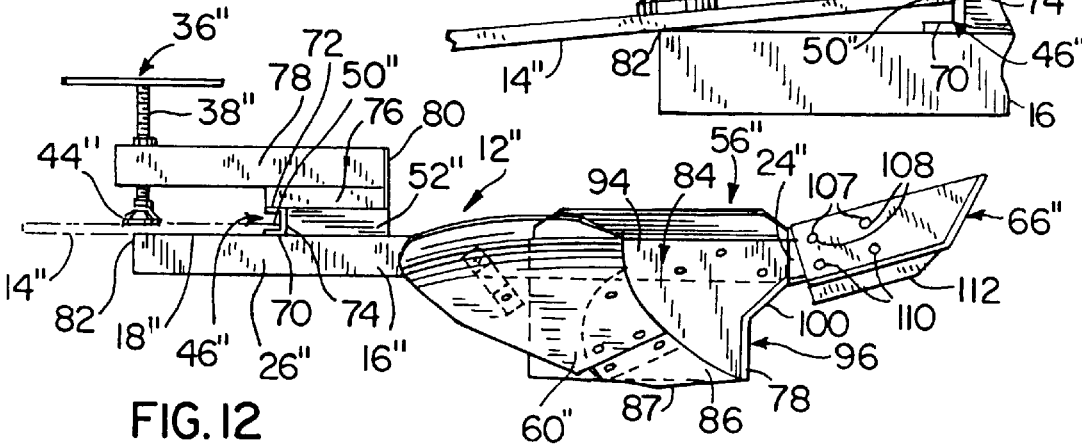
FIG. 12
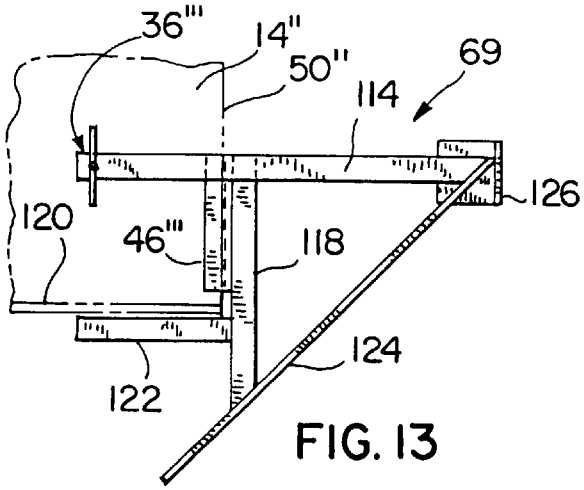
FIG. 13

METHOD OF AND APPARATUS FOR TRENCHING

CROSS-REFERENCE TO RELATED APPLICATIONS

This application is a continuation-in-part of U.S. patent application Ser. No. 08/423,224 filed Apr. 17, 1995, now U.S. Pat. No. 5,615,499.

STATEMENT REGARDING FEDERALLY SPONSORED RESEARCH OR DEVELOPMENT

Not applicable.

FIELD OF THE INVENTION

This invention relates broadly to trenching equipment, and deals more particularly with a trenching apparatus adapted for connection to the loading bucket of a construction vehicle for providing a furrow in which a silt fence is positioned.

BACKGROUND OF THE INVENTION

In any sort of construction work in which the earth is perturbed by any great amount, such as excavation for building foundations or altering topological grades, control methods are required to prevent erosion of the silt and soil such as caused by rainfall. These control methods are particularly important to the building and road construction industry and generally involve the use of a barrier in the form of a silt fence to address the problems of silt, soil and sand run off.

In order to install the silt fence, it is necessary to cut a narrow trench at the excavation site. After the silt fence is manually positioned in the furrow, the berm of the displaced soil left by the trenching operation must be filled back into the furrow to sustain the position of the silt fence.

Presently available trenching machines are generally larger and more expensive than desired for a narrow trenching job. In addition, such machines are often difficult to maneuver and their digging depth is difficult to control. As a result, trenching operations required for positioning of the silt fence may often require more manual labor than is desired.

It is the general aim of the present invention to provide a relatively simple, easily transportable trenching attachment which may be readily attached to various sizes of an existing tool, such as an earth moving bucket, located on the front end of a construction vehicle such as a skid steer vehicle or front end loader. It is further desirable to provide a trenching attachment which may be operated at any location on an excavation site and will consistently form a furrow in the range of 4–7 inches deep. It is also within the purview of this invention to provide a trenching device which may be readily removed from the bucket in order to efficiently backfill the furrow and sustain the silt fence in place.

BRIEF SUMMARY OF THE INVENTION

The present invention advantageously provides an improved excavation apparatus which converts an existing earth working bucket on a construction vehicle to a narrow trenching device. The trenching device is readily installed and removed from the bucket of the construction vehicle and permits the digging of furrows for the installation of silt fences used to prevent erosion at construction sites.

In one aspect of the invention, an excavation apparatus adapted for connection to a tool of a construction vehicle for providing a furrow in which a silt fence is positioned comprises a framework having a proximal end and a distal end, the framework including the trenching device positioned intermediate the proximal end and the distal end for digging the furrow in which the silt fence is positioned. The proximal end includes a mounting arrangement for clamping the framework to the tool of the construction vehicle and the distal end has a depth limiting arrangement for limiting the digging depth of the trenching device.

In another aspect of the invention, a trenching device for attachment to an earth working bucket provided on the front end of the vehicle comprises a rigid beam extending forwardly of the bucket, the beam having a right side, a left side, a proximal end and a distal end. A support assembly is spaced above and lies substantially parallel to the proximal end of the rigid beam and carries a mounting device for clamping the bucket inserted between the rigid beam and the support assembly against the rigid beam. A stabilizing member is disposed substantially transverse to the rigid beam and the support assembly and is engageable with a lower lip on the lower, forwardmost portion of the bucket. A moldboard is fixedly secured to the right side of the rigid beam between the proximal end and the distal end for digging a furrow as the vehicle advances. A skid plate is disposed on the distal end of the rigid beam at an acute angle with respect to the longitudinal centerline of the rigid beam and is guidable along a plane of the earth to limit the digging depth of the moldboard.

In yet a further aspect of the invention, an attachment for plowing earth used in conjunction with a loading bucket mounted on the front end of a vehicle comprises a rigid framework having a proximal end and a distal end and a mounting arrangement for releasably securing the proximal end of the framework in a fixed position to a loading bucket mounted on the front end of the vehicle to move commensurately with the loading bucket and relative to the vehicle. The framework includes a stabilizing member engageable with the loader bucket to hold the framework firmly against the loader bucket. The framework also includes a trenching arrangement disposed to one side thereof intermediate the proximal end and the distal end for engaging the earth and digging a furrow as the vehicle is advanced. The framework further includes a skid plate mounted on the distal end thereof at an acute angle with respect to the longitudinal centerline of the framework and guidable along the plane of the earth to limit the digging depth of the trenching arrangement.

In yet another aspect of the invention, there is contemplated a method of using a plowing implement to move earth, the implement being adapted for releasable connection to a loader bucket of a construction vehicle for providing a furrow in which a silt fence is positioned. The method comprises the steps of: providing a framework movable with the construction vehicle and having a proximal end and a distal end, the framework including a trenching device positioned intermediate the proximal end and the distal end, the proximal end having a mounting arrangement for releasably clamping the framework to the bucket of a construction vehicle and the distal end having a depth limiting arrangement for limiting the motion of the trenching device; advancing the construction vehicle along a digging path such that the trenching device will engage the earth and form a furrow, as governed by the depth limiting arrangement, the displaced earth from the furrow forming a berm; positioning a silt fence upright in the furrow; releasing the framework from the bucket using the mounting arrangement; and advancing the construction vehicle again along the digging path, the bucket being filled with earth such that the earth in the bucket will displace the earth from the berm back into the furrow as the bucket advances to sustain the position of the silt fence.

In still another aspect of the invention, an earth excavating apparatus adapted for connection to a tool of a construction vehicle for providing a furrow includes a frame having a proximal end and a distal end. A mounting arrangement is disposed on the proximal end of the frame for clamping the framework to the tool of the construction vehicle. An earth-engaging trenching device is secured to the frame intermediate the proximal end and distal end. The trenching device includes a landside having a forward facing cutting edge for cutting the earth and a laterally extending shield for deflecting excavated earth, a share having a downwardly facing cutting edge projecting from a lower portion of the landside, and a moldboard extending rearwardly and flaring outwardly from the landside. A skid is adjustably mounted at the distal end of the frame for limiting the digging depth of the trenching device. A frog is secured between the landside and the moldboard while a brace interconnects the frame and the moldboard. The skid includes a downwardly depending skag for steering and stabilizing the trenching device.

In still yet another aspect of the invention, a trenching device for attachment to a lower portion of an earth working bucket provided on the front end of a vehicle includes a frame releasably attached to the lower portion of the bucket. A landside is joined to the frame and has an earth excavating coulter integrally formed thereon, the coulter having a forward facing cutting edge. A share is fixed to the landside and has a downwardly facing, earth excavating cutting edge. A moldboard is mounted on the landside and has a curved section extending rearwardly of and flaring outwardly from the share. A frog is interconnected between the landside and the moldboard and a skid is adjustably secured to the frame for limiting the digging depth of the trenching device. The landside includes a hypercurl extending from an upper portion thereof for directing excavated earth to the moldboard. The forward facing cutting edge of the coulter includes a substantially vertically extending segment and a substantially upwardly and forwardly extending segment.

A further aspect of the invention relates to an excavation apparatus for attachment to an earth working bucket provided on the front end of a vehicle. A rigid beam extends forwardly of the bucket, the beam having a proximal end and a distal end. A support assembly is spaced above and lies substantially parallel to the proximal end of the rigid beam. The support assembly carries a mounting device for loosely clamping the bucket inserted between the rigid beam and the support assembly against the rigid beam. A stabilizing member is disposed substantially transverse to the rigid beam and the support assembly and is engageable with a lower lip on the lower, forwardmost portion of the bucket. The stabilizing member is constructed and arranged such that the lip floats within the stabilizing member when the bucket is clamped by the mounting device. A trenching device is secured to the rigid beam between the proximal end and the distal end, and a skid is adjustably mounted on the distal end of the rigid beam. The stabilizing member is substantially C-shaped in cross-section. The mounting device includes a rotatable bolt having a pressure plate mounted for pivotal movement on the bottom thereof. The pressure plate is engageable with the lower portion of the bucket upon rotation of the bolt to clamp the bucket downwardly against the beam. The proximal end of the beam defines a fulcrum about which the lower portion of the bucket pivots.

Another aspect of the invention contemplates a method of using a plowing implement to move earth. The implement is adapted for releasable connection to the tool of a construction vehicle for providing a furrow. The method comprises the steps of releasably securing a trenching device on the tool of the construction vehicle; advancing the construction vehicle such that the trenching device will engage the earth and form a furrow, the displaced earth from the furrow forming a berm; releasing the trenching device from the tool of the construction vehicle; releasably securing a backfilling device on the tool of the construction vehicle; and advancing the construction vehicle again along the digging path such that the backfilling device will displace the earth from the berm back into the furrow.

Furthermore, another aspect of the invention contemplates a method of using a plowing implement to move earth. The implement is adapted for releasable connection to a tiltable loader bucket of a construction vehicle for providing a furrow in which a silt fence is positioned. The method comprises the steps of providing a first frame movable with the construction vehicle and having a proximal end and a distal end, the first frame including a trenching device intermediate the proximal end and the distal end, the proximal end having a first mounting arrangement for releasably securing the first frame to the bucket of the construction vehicle and the distal end having a depth limiting arrangement for limiting the motion of the trenching device; securing the first frame to the bucket of the construction vehicle using the first mounting arrangement; advancing the construction vehicle along a digging path such that the trenching device will engage earth and form a furrow, as governed by the depth limiting arrangement, the displaced earth from the furrow forming a berm; positioning a silt fence upright in the furrow; releasing the first frame from the bucket of the construction vehicle using the first mounting arrangement; providing a second frame movable with the construction vehicle, the second frame including a backfilling device having a second mounting arrangement for releasably securing the second frame to the bucket of the construction vehicle; securing the second frame to the bucket of the construction vehicle using the second mounting arrangement; and advancing the construction vehicle again along the digging path such that the backfilling device will displace the earth of the berm back into the furrow as the bucket advances to sustain the position of the silt fence. The method also includes the step of compacting the backfilled furrow.

Yet another aspect of the invention relates to earth moving equipment adapted for connection to the tool of a construction vehicle. A trenching device is attachable to and detachable from the tool of the construction vehicle, and is engageable with the earth to form a furrow, the displaced earth forming a berm. A backfilling device is releasably secured to the tool of the construction vehicle upon detachment of the trenching devices and is used to displace earth from the berm back into the furrow.

BRIEF DESCRIPTION OF THE SEVERAL VIEWS OF THE DRAWING

The invention will become better understood by reference to the following detailed description of the preferred exemplary embodiment when read in conjunction with the appended drawing wherein like numerals denote like elements.

FIG. 9 is a perspective view of another alternative embodiment of the excavation attachment along with a backfilling device used in conjunction therewith;

FIG. 10 is a perspective, partially exploded view of the excavation attachment of FIG. 9;

FIG. 11 is a top view of the excavation attachment of FIG. 9;

FIG. 12 is an elevational view of the excavation attachment of FIG. 9;

FIG. 12*a* is an enlarged, detail view of the mounting of the excavation attachment of FIG. 12 to the bucket;

FIG. 13 is a top view of the backfilling device shown in FIG. 9; and

FIG. 14 is a detail view depicting the compacting of the soil-filled furrow following use of the backfilling device.

DETAILED DESCRIPTION OF THE INVENTION

Figure 1:
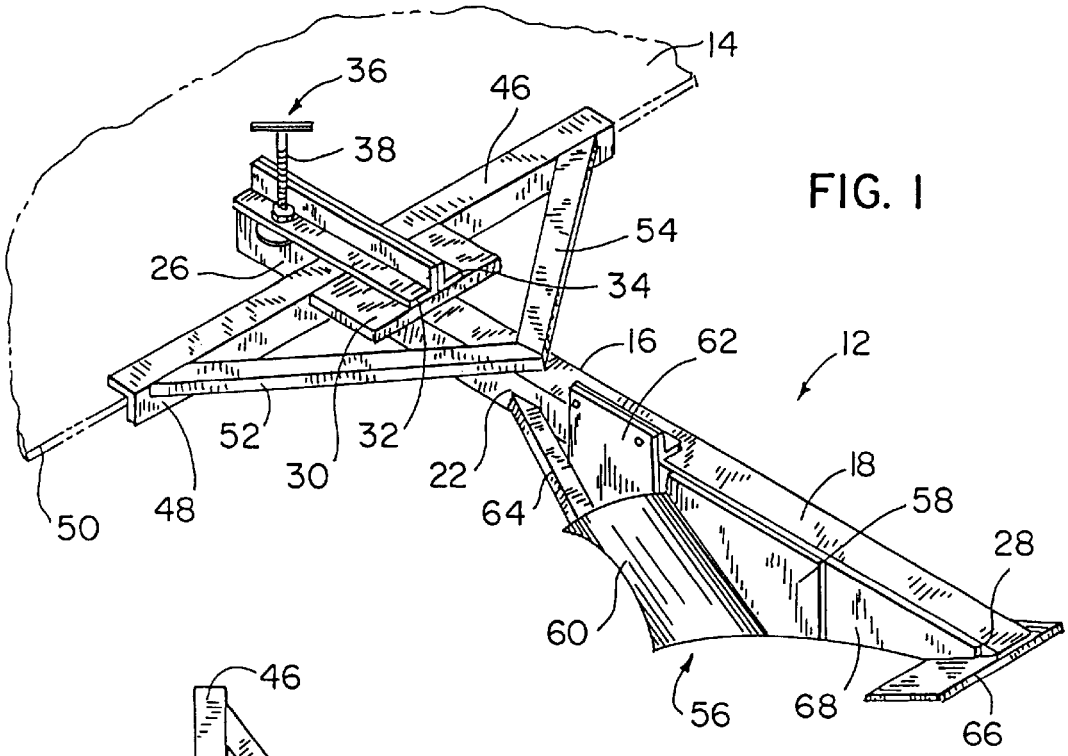
FIG. 1 is a perspective view of the excavation attachment embodying the present invention.
Figure 2:
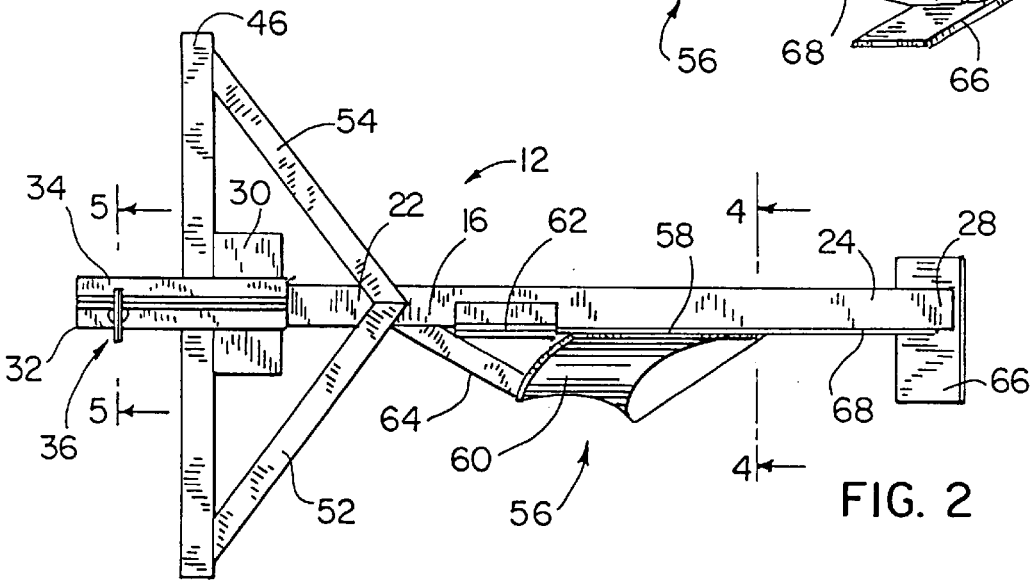
FIG. 2 is a top view of the excavation attachment shown in FIG. 1.
Figure 3:
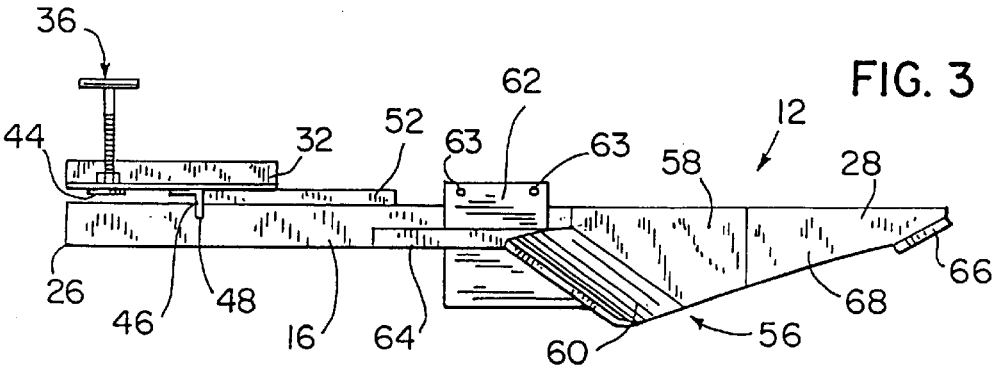
FIG. 3 is an elevational view of the excavation attachment shown in FIG. 1.
Figure 5:
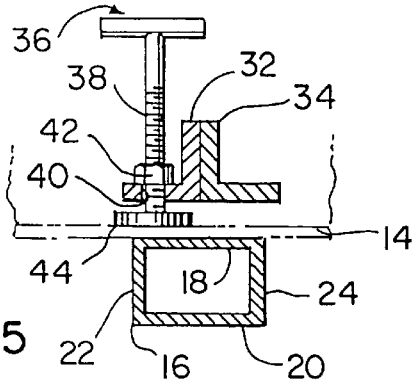
FIG. 5 is a cross-sectional view taken on line 5—5 of FIG. 2.
Figure 4:
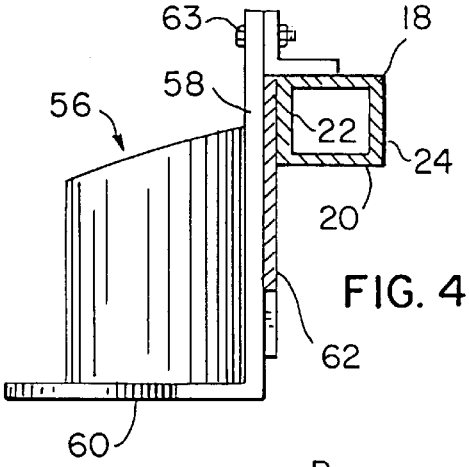
FIG. 4 is a cross-sectional view taken on line 4—4 of FIG. 2.

In the drawings and description which follow, an excavation apparatus embodying the present invention and generally identified by the reference numeral 12 is shown releasably mounted to a tool or earth moving bucket 14 of a construction vehicle such as a front end loader or skid steer vehicle. As is well known, the construction vehicle includes suitable controls (not shown) for controlling the movement and orientation of the bucket 14.

Examining the excavation apparatus 12 of FIGS. 1–5 in greater detail, it is preferably fabricated of a heavy duty, welded metal construction and includes a rigid framework in the form of a substantially square or rectangular beam or angle iron 16 extending forwardly of bucket 14. Beam 16 has a top 18, a bottom 20, a right side 22, a left side 24, a proximal end 26 and a distal end 28. The proximal end 26 of beam 16 carries along its top 18 a filler plate 30 on the upper surface of which a support assembly formed by two back-to-back angle irons 32, 34 is positioned. Angle iron 32 provides support for a mounting device 36 used to releasably secure the framework to bucket 14. Mounting device 36 comprises a rotatable T bolt assembly having a T shaft 38 which passes through an aperture 40 drilled in angle iron 32 and which is threadably adjustable in a nut 42 straddling the aperture 40. The bottom of shaft 38 is provided with a circular pressure plate 44 which is rotatably adjusted towards and away from the bucket 14 inserted between angle irons 32, 34 and beam 16 to clamp bucket 14 between pressure plate 44 and beam 16 as shown best in FIG. 5.

A stabilizing member 46 in the form of an angle iron is disposed substantially transverse to and mounted on beam 16 and has a leg 48, the forward side of which abuts filler plate 30. The rearward side of leg 48 interfaces against a lip 50 on the lower, forwardmost portion of bucket 14 over substantially the entire width thereof. The framework includes a pair of support gussets 52, 54, each of which extend at an angle from an end of stabilizing member 46 to the top of beam 16 at a position spaced slightly forwardly of filler plate 30 and angle irons 32, 34.

A trenching device 56 in the form of a moldboard is welded or otherwise fixedly secured to the right side 22 of beam 16 intermediate proximal end 26 and distal end 28 for digging a narrow trench as the vehicle advances. Moldboard 56 includes a vertically disposed planar portion 58 and a curved, flared portion 60. A reinforcing plate assembly 62 extending above and below the right side 22 of beam 16 behind moldboard 56 is secured to beam 16 by removable fasteners 63. To further add support, a reinforcing strut 64 extends from the rearmost edge of moldboard 56 to right side 22 of beam 16 slightly forward of the junction between support gussets 52, 54. A skid plate 66 disposed at an acute angle of approximately 30° from the longitudinal centerline of beam 16 serves as a depth limiting arrangement for limiting the depth of trenching device 56. To provide greater support, the right side 22 of beam 16 includes an enlarged portion 68 extending along the distal end 28. Portion 68 defines an angled lower edge which functions to "slice" turf as apparatus 12 advances to prevent build-up of turf on the forward edge of vertical portion 58.

Figure 6:
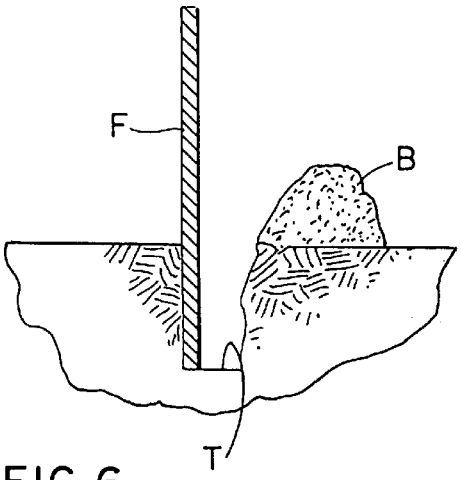
FIG. 6 is a representation of a silt fence positioned in an excavation formed by the present invention.
Figure 7:
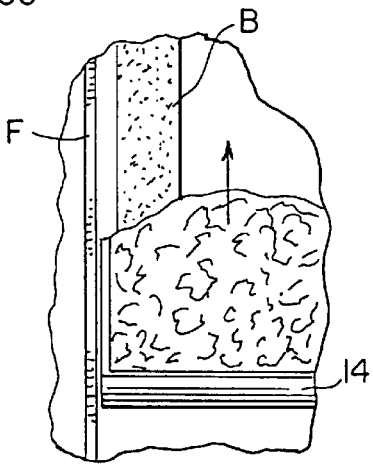
FIG. 7 is an illustration showing the technique used in replacing the excavated soil shown in FIG. 6.

In use, excavation apparatus 12 is clamped to bucket 14 using mounting device 36 and making sure stabilizing member 46 is held tightly against the lip 50 of bucket 14. With the lower surface of bucket 14 positioned at the desired trenching angle to and spaced slightly above the plane of the earth to be excavated, the construction vehicle is advanced along the digging path such that the trenching device 56 will cut a narrow trench T (FIG. 6) on the right side of the apparatus, the displaced earth forming a berm B next to trench T. Ideally, the depth of the trench T is 4–7 inches, such parameter being held in a relatively constant range by the angular disposition (i.e. 30° relative to the longitudinal centerline of beam 16) of skid plate 66. After trench T has been formed, construction workers initially position a silt fence F upright against the wall of the trench T. When the trenching operation is concluded, apparatus 12 is releasably removed from bucket 14 by unscrewing mounting device 36. Then, as seen in FIG. 7, bucket 14 is filled with earth and the construction vehicle retraces along the original digging path, the large surface area provided by earth in the advancing bucket 14 used to push against the berm B and replace soil in the furrow to sustain the upright position of silt fence F.

Figure 8:
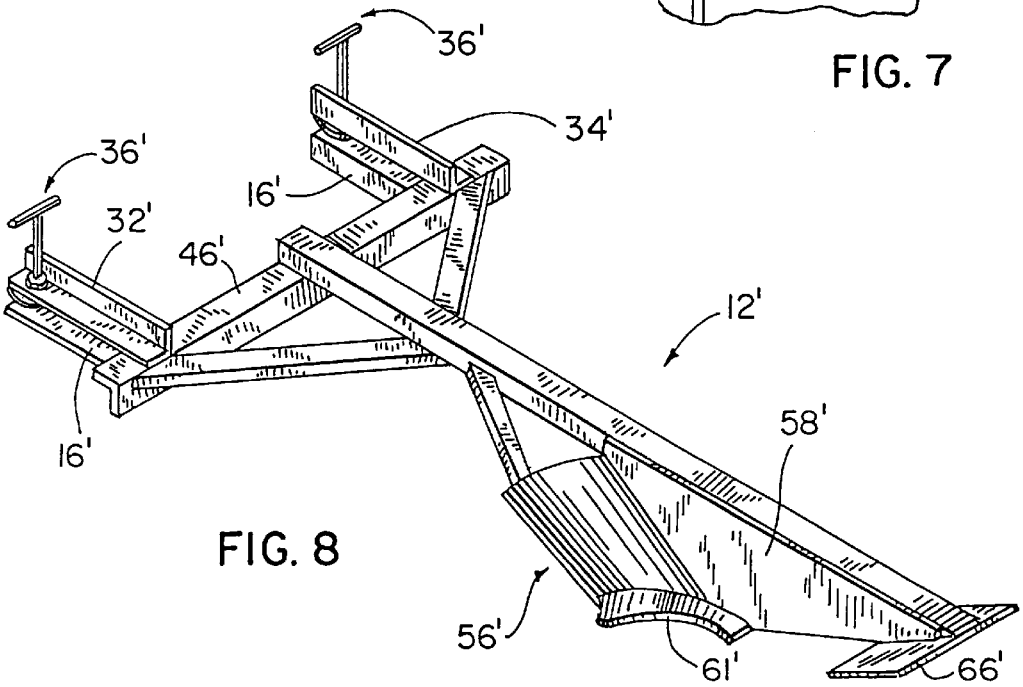
FIG. 8 is a perspective view of an alternative embodiment of the present invention.

FIG. 8 shows an alternative embodiment of the invention in which two mounting devices 36' are utilized to provide a greater mounting stability for the trenching attachment. In this embodiment, one mounting device 36' is supported on an angle iron 32' for clamping the bucket against a beam extension 16' projecting from stabilizing member 46'. The other mounting device 36' is supported from angle iron 34' for clamping the bucket against another beam extension 16' projecting from stabilizing member 46'. In addition, the planar portion 58' of trenching device 56' is enlarged to serve as a greater mounting surface for attachment to beam 16. Planar portion 58' defines an angled front edge which extends entirely between skid plate 66' and moldboard lower lip 61'.

FIGS. 9–14 show another alternative embodiment of the invention. In this version, an excavation apparatus 12" is accompanied by a backfilling device 69 to be more fully described hereafter. As shown in FIG. 9, excavation apparatus 12" and backfilling device 69 are both releasably mounted to the bucket 14" of the construction vehicle only for the purpose of conveniently transporting both attachments to the digging site. When it is desired to begin a trenching operation, backfilling device 69 is removed and excavation apparatus 12" is repositioned on the bucket 14" as will be appreciated in the discussion of the operation to follow.

As seen best in FIGS. 10 and 12, the proximal end 26" of beam 16" carries along its top support gussets 52", 54" which are integrally formed at their rearward ends with a push bar 46" defining a stabilizing member for receiving the lip 50" of bucket 14". Push bar 46" is generally C-shaped in cross-section and includes a horizontally disposed lower wall 70 running along the top 18" of beam 16", a horizontally disposed upper wall 72 supporting the rearward end of a spacer 76 mounted on the upper surface of support gussets 52", 54" and a vertically oriented forward wall 74 joining walls 70 and 72. An arm 78 is secured on top of spacer 76 and forms a support assembly for a mounting device 36" used to releasably secure the frame to bucket 14". Mounting device 36" is commercially available from S & W Manufacturing Company, Inc. of Bensenville, Ill. A plate-like cap 80 ties the forward ends of spacer 76 and arm 78 together for reinforcement against the forces imposed upon the apparatus.

Referring to FIGS. 12 and 12*a*, mounting device 36" is suitably provided such that pressure plate 44" has limited pivotal movement (approximately 10°) as the plate 44" is rotatably adjusted towards and away from bucket 14" to clamp bucket 14" to beam 16". In addition, beam 16" extends rearwardly slightly beyond the rotational axis of T-bolt 38" so that the lower end of bucket 14" pivots about a fulcrum 82 defined by the uppermost, rearwardmost point on beam 16" thereby causing the lip 50" of bucket 14" to move within a range (typically 2 inches) between lower wall 70 and upper wall 72 of push bar 46". With this arrangement, the excavation apparatus 12" is provided with a floating attachment to the bucket 14" which will allow the apparatus to maintain contact with the ground surface as the construction vehicle travels over uneven terrain. Such feature is particularly significant when using a skid steer vehicle having a short wheel base and suspension on which significant forces may be imposed depending on the digging site terrain.

As best seen in FIG. 10, trenching device 56" is unilaterally positioned on right side 22" of beam 16", and comprises a landside 84, a share 86, a moldboard 60", a frog 88 and a moldboard brace 64". Landside 84 has a generally vertically planar section 90 attached to the right side 22" of beam 16" such as by fasteners 92. Planar section 90 has an upwardly extending hypercurl shield or sod roller 94 to prevent excavated sod from rolling over moldboard 60" during trenching. A forwardly facing cutting edge 96 is integrally formed on landside 84 and includes a vertically extending segment 98, and an upwardly and forwardly extending segment 100. Cutting edge 96 defines a coulter which is essential for maintaining a desired furrow depth when operating in grassy areas. Brace 64" has an outer end 67 connected to moldboard section 60" by fastener 103, and an inner end 65 joined to the beam 16" by fastener 106. Plow share 86 has a downwardly facing cutting edge 87, and is secured by fasteners such as 102 to frog 88 and the horizontally disposed bottom edge 85 of landside 84. Curved moldboard section 60" (FIG. 11) extends rearwardly and flares outwardly, and is joined such as by fastener 104 to frog 88 and landside 84. The upper end of frog 88 is secured to the rearward end of landside 84 by fastener 105. The rearmost portion of moldboard section 60" is supported by the brace 64" extending between the right side 22" of beam 16" and the backside of moldboard section 60".

A skid plate 66" for limiting the digging depth of trenching device 56" is adjustably mounted by fasteners 107 on the free end 24" of beam 16". In one setting, fasteners 107 pass through aligned openings 108 in skid plate 66" and beam 16". In another setting, fasteners 107 are removed, skid plate 66" is moved to align the other openings 110 with those in the skid plate 66" and the fasteners 107 are reinstalled. The bottom of skid plate 66" includes a skag 112 for steering and stabilizing the trenching device 56" and counteracting the yaw or side-to-side forces of the apparatus as encountered during the trenching process.

Turning now to FIGS. 9 and 13, backfilling device 69 used in conjunction with the above-described excavation apparatus 12" is releasably secured to the right corner of bucket 14" using a mounting device 36'" similar to mounting device 36" as described above. While backfilling device 69 may be transported to the digging site by the construction vehicle carrying the excavation apparatus 12", it should be understood that the backfilling device 69 is separately installed on bucket 14" in place of excavation apparatus 12" once the furrows have been dug.

Backfilling device 69 comprises an upper horizontal beam 114 extending over the top of the bucket lip 50" and supporting mounting device 36'". A lower horizontal beam 116 lies generally parallel to upper beam 114 and extends beneath the bucket lip 50". Pressure plate 44'" of mounting device 36'" clamps the bucket 14" against lower beam 116. A transverse member 118 having a portion 119 joined between beams 114, 116 projects generally perpendicularly from upper beam 114 and across the front edge of bucket 14". As seen in FIG. 13, member 118 includes a stabilizing member 46'" engageable against the lip 50" of bucket 14". Joined substantially orthogonally to member 118 and lying along an outside wall 120 of bucket 14" is a C-shaped channel iron 122. A backfilling wing 124 is connected to respective free ends of upper and lower beams 114, 116 and member 118 so that it is at an angle of approximately 45° to the front of the bucket 14".

An L-shaped skid plate 126 is secured to the bottom, innermost end of wing 124 for reinforcement. Wing 124 has a bottom reinforcing member 125.

In use, backfilling device 69 is removed from the bucket 14", and excavation apparatus 12" is repositioned at the center of bucket and secured using mounting device 36" as described above. Construction vehicle is advanced along a digging path such that trenching device 56" will form a narrow trench T, the displaced earth forming a berm next to the trench T. However, it should be understood that the arrangement of excavation apparatus 12" provides enhanced trenching action in comparison with excavation apparatus 12 and 12'. That is, excavation apparatus 12" is capable of handling pushing forces induced by a 20–100 horsepower construction vehicle. In particular, the integral coulter 96 cooperates with adjustable skid plate 66" to maintain the desired furrow depth when operating in grassy areas. As sod is cut, hypercurl shield 94 keeps the sod from rolling over the top of the moldboard 60". In addition, hypercurl shield 94 interacts with the extreme forward positioning of moldboard 60" to throw spoils in an upslope direction as generally required in silt fence installation. It is also noted that unlike the rigid clamping of the prior art trenching devices, the present invention enables a floating attachment of excavation apparatus 12" which enables the apparatus 12" to maintain contact with the ground surface without damaging bucket 14" while the construction vehicle travels over uneven terrain. The degree of trenching may also be effected by tilting the bucket and framework of excavation apparatus 12" according to the hardness of the earth being excavated. Once the trench T has been dug and the silt fence has been positioned, excavation apparatus 12" is removed and backfilling device 69 is attached to the right side of bucket 14" using mounting device 36'" as depicted in FIGS. 9 and 13. Then, the construction vehicle is advanced in the direction opposite to that travelled during furrow formation such that wing 124 will push against the berm and replace soil in the furrow to anchor the position of the silt fence F. Backfilling device 69 is then removed and soil replaced in the furrow may then be compacted by driving the left side tires 128 of the construction vehicle over the filled furrow as depicted in FIG. 14.

It should be appreciated that the present invention provides an improved plowing or trenching attachment which will enable a controlled range of trenching without complicated mechanical or hydraulic components. It should be further understood that the present invention enables a relatively consistent trenching operation which may be easily started and stopped according to movement of the construction vehicle. It should also be understood that the simplified yet effective installation and removal of the trenching apparatus saves time and effort normally expended in prior art trenching operations on construction sites. Due to the relatively manageable weight (approximately 145 lbs.) of excavation apparatus 12, 12', 12" and backfilling device 69 it generally requires one worker only a few minutes time to complete installation and removal on the bucket of the construction vehicle. At the same time, it should be noted that the combination of the mounting device 36, 36', 36", 36'" and stabilizing member 46, 46', 46" used during installation, removal and trenching operations is intended to provide positive securement without inflicting damage to the bucket or construction vehicle.

While the invention has been described with reference to a preferred embodiment, those skilled in the art will appreciate that certain substitutions, alterations and omissions may be made without departing from the spirit thereof. For example, various types of trenching devices may be used in place of moldboard 56, 56', 56". Likewise, different depth limiting arrangements other than skid plate 66, 66', 66" may be employed as desired. It should also be understood that while the preferred embodiment describes the invention as used in a trenching operation for silt fences, the excavation apparatus of the present invention may also be used in other applications involving cyclone fence, lawn lighting, and lawn sprinkler installation, crop irrigation, landscape edging, tree nurseries and planting. Accordingly, the foregoing description is meant to be exemplary only, and should not be deemed limitative on the scope of the invention set forth with the following claims.

We claim:

1. Earth excavating apparatus adapted for connection to a tool of a construction vehicle for providing a furrow, said apparatus comprising:

a frame having a proximal end and a distal end;

a mounting arrangement on said proximal end of said frame for clamping said frame to the tool of the construction vehicle;

an earth-engaging trenching device secured to said frame intermediate said proximal end and said distal end, said trenching device including a landside having a forward facing cutting edge for cutting the earth and a laterally extending shield for deflecting excavated earth, a share having a downwardly facing cutting edge projecting from a lower portion of said landside, and a moldboard extending rearwardly and flaring outwardly from said landside; and a skid mounted at the distal end of said frame for limiting a digging depth of said trenching device.

2. The earth excavating apparatus of claim 1, including a frog secured between said landside and said moldboard.

3. The earth excavating apparatus of claim 1, including a brace interconnecting said frame and said moldboard.

4. The earth excavating apparatus of claim 1, wherein said skid includes a downwardly depending skag for steering and stabilizing said trenching device.

5. The earth excavating apparatus of claim 1, wherein said skid is adjustable.

6. A trenching device for attachment to a lower portion of an earth working bucket provided on the front end of a vehicle, the device comprising:

a frame adapted for releasable attachment to the lower portion of said bucket;

a landside joined to said frame, said landside having an earth excavating coulter integrally formed thereon, said coulter having a forwardly facing cutter edge;

a share fixed to said landside, said share having a downwardly facing, earth excavating cutting edge;

a moldboard mounted on said landside and having a curved section extending rearwardly of and flaring outwardly from said share;

a frog interconnected between said landside and said moldboard; and a skid secured to said frame for limiting a digging depth of the trenching device.

7. The trenching device of claim 6, wherein said landside includes a hypercurl extending from an upper portion thereof for directing excavated earth to said moldboard.

8. The trenching device of claim 6, wherein said forwardly facing cutting edge includes a substantially vertically extending segment and a substantially upwardly and forwardly extending segment.

9. The trenching device of claim 6, wherein said skid is adjustable.

10. Excavation apparatus for attachment to an earth working bucket provided on a front end of a vehicle, said earth working bucket having a lower, forwardmost portion provided with a lower lip, the apparatus comprising:

a rigid beam extending forwardly of the bucket, said beam having a proximal end and a distal end;

a support assembly interconnected with said proximal end of said rigid beam, said support assembly having a mounting device for engaging the bucket and providing relative movement between the rigid beam and the bucket;

a stabilizing member disposed substantially transverse to said rigid beam and said support assembly and adapted for engagement with the lower lip on the lower, forwardmost portion of the bucket; said stabilizing member being constructed and arranged such that said lip moves relative to said stabilizing member when said bucket is engaged by said mounting device, wherein said stabilizing member includes structure engageable with said lip for limiting movement of said bucket relative to said rigid beam;

a trenching device secured to said rigid beam between said proximal end and said distal end; and a skid mounted on said distal end of said rigid beam.

11. The excavation apparatus of claim 10, wherein said stabilizing member is substantially C-shaped in cross-section.

12. The excavation apparatus of claim 10, wherein said mounting device includes a rotatable bolt having a pressure plate mounted for pivotal movement at a bottom end thereof, said pressure plate being engageable with a lower portion of the bucket upon rotation of said bolt to clamp the bucket downwardly against said rigid beam.

13. The excavation apparatus of claim 10, wherein said proximal end of said rigid beam defines a fulcrum about which a lower portion of said bucket pivots.

14. The excavation apparatus of claim 10, wherein said trenching device is secured to one side of said rigid beam.

* * * * *